US008282301B2

(12) United States Patent
Larsen et al.

(10) Patent No.: US 8,282,301 B2
(45) **Date of Patent: *Oct. 9, 2012**

(54) PRE-SOAPED, DISPOSABLE LUFFAH

(75) Inventors: Bruce T. Larsen, Las Vegas, NV (US); Bryan W. Larsen, Las Vegas, NV (US)

(73) Assignee: Larsen Concepts, LLC, Las Vegas, NV (US)

( * ) Notice: Subject to any disclaimer, the term of this patent is extended or adjusted under 35 U.S.C. 154(b) by 1065 days.

This patent is subject to a terminal disclaimer.

(21) Appl. No.: 12/188,747

(22) Filed: Aug. 8, 2008

(65) Prior Publication Data

US 2009/0038100 A1 Feb. 12, 2009

Related U.S. Application Data

(63) Continuation-in-part of application No. 12/049,955, filed on Mar. 17, 2008, which is a continuation-in-part of application No. 11/836,701, filed on Aug. 9, 2007, now Pat. No. 7,589,053.

(51) Int. Cl.
*A47K 7/02* (2006.01)

(52) U.S. Cl. ..... 401/201; 401/6; 15/104.93; 510/441

(58) Field of Classification Search ..... 401/6, 201; 15/104.93, 118, 209.1; 510/441
See application file for complete search history.

(56) References Cited

U.S. PATENT DOCUMENTS 2,593,689 A 4/1952 Mitchell
3,233,727 A 2/1966 Wilson
3,512,839 A * 5/1970 Jouffroy ..... 401/201
D257,227 S 10/1980 Youngberg
4,377,598 A 3/1983 Nugent
5,312,197 A * 5/1994 Abramson ..... 401/6
5,650,384 A 7/1997 Gordon et al.
5,716,005 A 2/1998 McMahan
5,875,511 A 3/1999 Mejdl
5,944,032 A 8/1999 Masterson
5,952,090 A 9/1999 Fan
6,015,242 A * 1/2000 Gillis ..... 401/201
D425,423 S 5/2000 Mengeau et al.
6,092,717 A 7/2000 Lowry
6,210,062 B1 * 4/2001 Kokubo ..... 401/201
6,368,003 B1 4/2002 Sorrell
6,846,784 B2 1/2005 Engel et al.
6,871,375 B2 * 3/2005 Borcherds ..... 401/201
6,883,994 B1 4/2005 Grogg
6,902,338 B2 6/2005 Puvvada et al.
(Continued)

OTHER PUBLICATIONS

PET MSDS, http://www.kuraray.co.jp/en/products/msds/pdf/O2RI0230-1-055646.pdf, p. 5.

*Primary Examiner* — Tuan N Nguyen
(74) *Attorney, Agent, or Firm* — Greenberg Traurig

(57) ABSTRACT

Described is a luffah having of a series of ruffles wherein a substantially dry, water-soluble, cleansing and/or moisturizing agent is present on the ruffles at a center portion of the luffah. Enough cleaning agent or moisturizer is present to allow the luffah to be used at least once. A method of forming a luffah herein includes injecting a substantially wet, cleansing and/or moisturizing agent at, or near, a core of a luffah which is then compressed around the injected cleansing and/or moisturizing agent. The substantially wet, cleansing and/or moisturizing agent is then allowed to dry into a generally dry, water-soluble, cleansing and/or moisturizing agent at the core of the luffah.

13 Claims, 10 Drawing Sheets

U.S. PATENT DOCUMENTS

| | | | | |
|---|---|---|---|---|
| 7,419,321 | B2 * | 9/2008 | Tereschouk | 401/201 |
| 7,589,053 | B2 * | 9/2009 | Larsen et al. | 510/441 |
| 2003/0000039 | A1 | 1/2003 | Borcherds | |
| 2004/0242097 | A1 | 12/2004 | Hasenoehri et al. | |
| 2005/0000046 | A1 | 1/2005 | Popovsky et al. | |
| 2005/0130536 | A1 | 6/2005 | Sibers et al. | |
| 2005/0238701 | A1 | 10/2005 | Kleinwaechter | |
| 2005/0276827 | A1 | 12/2005 | Macedo et al. | |
| 2007/0039116 | A1 | 2/2007 | Woodard et al. | |

* cited by examiner

PRE-SOAPED, DISPOSABLE LUFFAH

CROSS-REFERENCE

This application is a continuation-in-part of U.S. application Ser. No. 12/049,955 filed Mar. 17, 2008, which is a continuation-in-part of U.S. application Ser. No. 11/836,701 filed Aug. 9, 2007 now U.S. Pat. No. 7,589,053.

FIELD OF THE INVENTION

The embodiments of the present invention relate to a ready-to-use, pre-soaped luffah.

BACKGROUND

Luffahs (aka Loofahs, Luffas and bath nets) are now ubiquitous items found in most households. Luffahs are used to apply soap and other cleansers to the body. In general, a luffah is soaked with water and then an ample amount of liquid soap, gel or similar cleansing and/or moisturizing agent is applied to the luffah and then used on the body in a sponge-like manner. However, luffahs are difficult to effectively rinse after use because of the ruffled configuration such that bacteria and other germs can be transferred from one user to another.

Thus, there exists a need for ready-to-use, disposable luffah.

SUMMARY

Accordingly, a first embodiment of the present invention is a cleansing article comprising: a luffah formed of a series of ruffles; said ruffles of said luffah coated with a substantially dry, water-soluble, cleansing and/or moisturizing agent such that said luffah may be used one or more times without an application of additional cleansing and/or moisturizing agent.

Another embodiment of the present invention is a method comprising: applying a substantially wet, cleansing and/or moisturizing agent to at least a portion of a luffah; and drying said luffah such that said applied substantially wet, cleansing and/or moisturizing agent forms into a generally dry, water-soluble, cleansing and/or moisturizing agent on at least a portion of a series of luffah ruffles. In one embodiment, the luffah is then packaged.

An alternative embodiment of the present invention is a cleansing article comprising: a luffah having of a series of ruffles; and a pouch positioned within said ruffles of said luffah wherein said pouch contains a cleansing and/or moisturizing agent, said pouch being water-soluble. In a first embodiment, the pouch contains a liquid cleansing and/or moisturizing agent. In an alternative embodiment, the pouch contains a powered cleansing and/or moisturizing agent.

In another embodiment, the cleansing article comprises: a luffah having of a series of ruffles; and wherein a substantially dry, water-soluble, cleansing and/or moisturizing agent is present on the ruffles at a center portion of the luffah. An alternative method embodiment comprises: applying a substantially wet, cleansing and/or moisturizing agent to ruffles of a luffah at a center portion of said luffah; and drying said luffah such that said applied substantially wet, cleansing and/or moisturizing agent forms into a generally dry, water-soluble, cleansing and/or moisturizing agent.

Another embodiment of the present invention is a method of fabricating a cleansing device comprising: injecting a substantially wet, cleansing and/or moisturizing agent at, or near, a core of a luffah; compressing said luffah around said injected cleansing and/or moisturizing agent; and allowing said applied substantially wet, cleansing and/or moisturizing agent to dry into a generally dry, water-soluble, cleansing and/or moisturizing agent at said core of said luffah.

The cleansing and/or moisturizing agent may be a soap, body gel, anti-bacterial soap, moisturizing soap and the like. By adding water to the pre-soaped luffah, the luffah is ready to use without the application of a separate liquid cleansing and/or moisturizing agent. As a result, using the luffah in a shower or bath is as simple as unpacking the luffah, placing it in the water stream or tub of water and using it in a sponge-like fashion.

Other variations, embodiments and features of the present invention will become evident from the following detailed description, drawings and claims.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
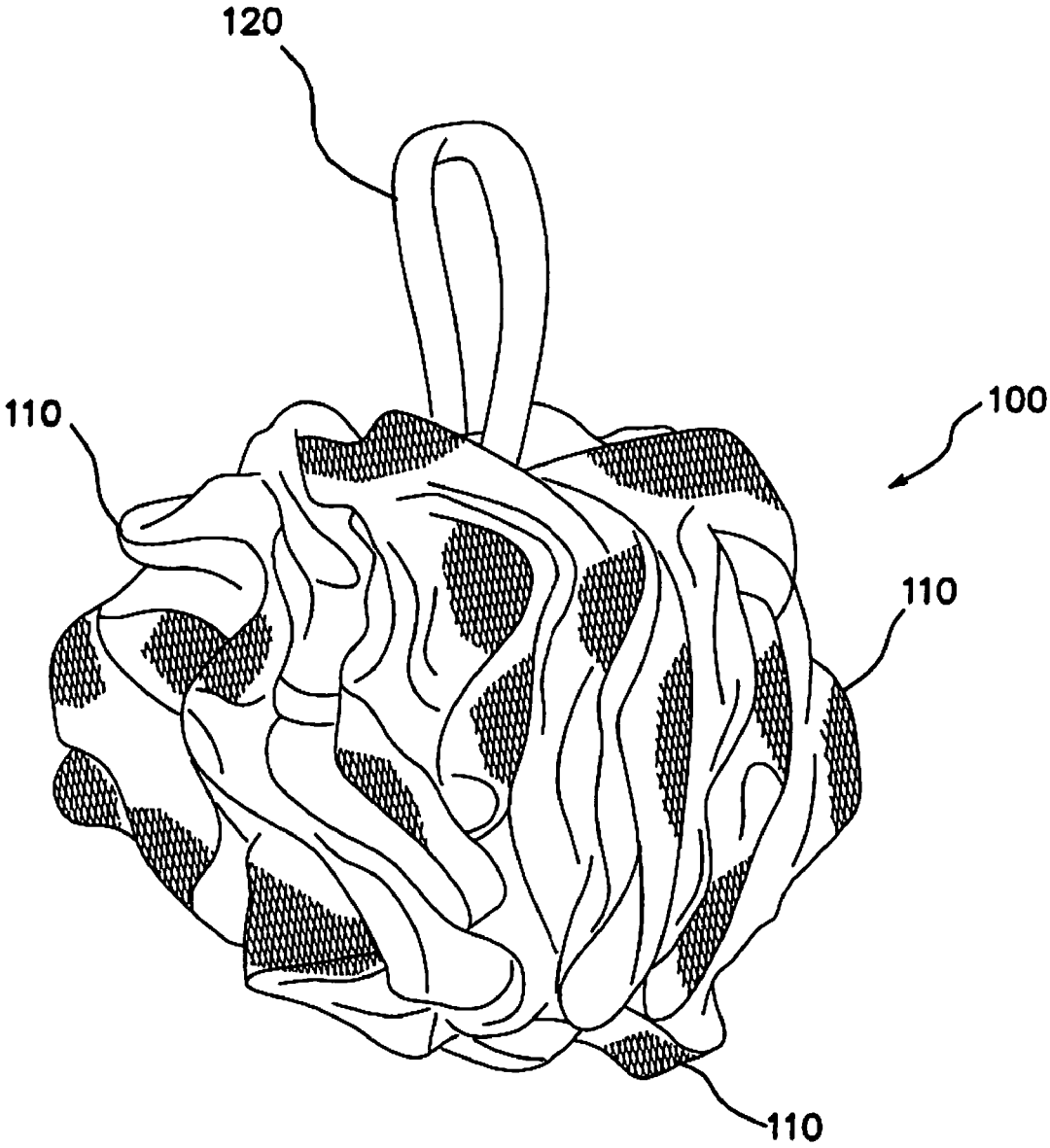
FIG. 1 illustrates a luffah of the type that may be used with the embodiments of the present invention.

Initial reference is made to FIG. 1 illustrating a luffah 100. The luffah 100 is formed of a series of ruffles 110 forming a circular configuration. A string 120 provides means for handling and hanging the luffah 100. The string 120 may also act as a support for maintaining the luffah 100 in its shape and configuration. It will be recognized by those skilled in the art that the luffah 100 may take other shapes and not necessarily include the string.

The embodiments of the present invention comprise a luffah 100 as shown in FIG. 1 with a cleansing and/or moisturizing agent (e.g., clear liquid soap) impregnated therein. In a first embodiment, the luffah 100 is coated or soaked in a substantially wet, cleansing and/or moisturizing agent like clear liquid soap, gel, bath wash, body wash, moisturizer or a similar agent or combinations thereof. Although a clear cleansing and/or moisturizing agent has been found to work well, other non-clear cleansing and/or moisturizing agents are suitable as well. In one embodiment, the luffah 100 is soaked in a pool or container of substantially wet, cleansing and/or moisturizing agent for a time period sufficient to coat the luffah 100. Alternatively, the luffah 100 may be sprayed with the cleansing and/or moisturizing agent. Those skilled in the art will understand that there may be means, other than soaking and spraying, for applying or coating the luffah 100 with the cleansing and/or moisturizing agent. This application is intended to cover those means as well. With the soaking method, after soaking, the luffah 100 is removed from the pool or container of the wet, cleansing and/or moisturizing agent and allowed to dry. Alternatively, the luffah 100 is removed from the spraying process. Depending on the method used, the luffah 100 may be dried with ambient air or a separate heat source may be used to more quickly dry the luffah 100. As a result, the wet, cleansing and/or moisturizing agent dries on the ruffles 110 thereby creating a luffah 100 impregnated or coated with a cleansing and/or moisturizing agent.

In an alternative embodiment, the cleansing and/or moisturizing agent is applied only to a central portion or core of the luffah 100. In this embodiment, the cleansing and/or moisturizing agent dries near the core of the luffah 100 and as such is not on the outer portions of the ruffles 110. With such an embodiment, the luffah 100 has the same feel as a conventional non-soaped luffah. However, once water is applied, the cleansing and/or moisturizing agent quickly disperses throughout the ruffles 110 of the luffah 100.

Figure 2:
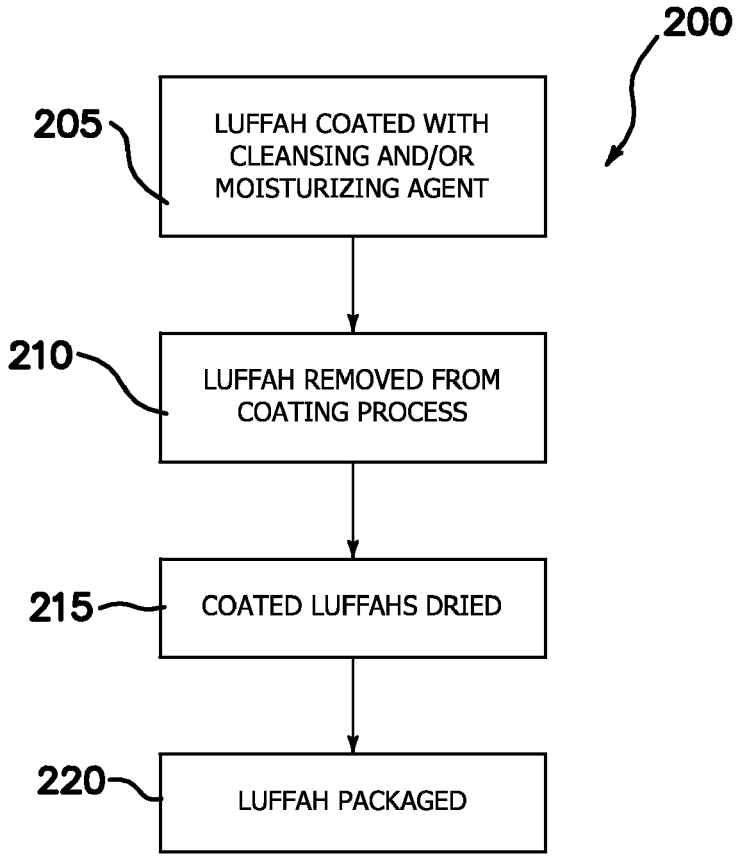
FIG. 2 illustrates a flow chart detailing a method of fabricating a luffah according to the embodiments of the present invention.

FIG. 2 shows a flow chart 200 detailing a method of fabricating a luffah 100 according to the embodiments of the present invention. At 205, a luffah 100 is coated in a cleansing and/or moisturizing agent. In a mass production method, a plurality of luffahs 100 are suspended by their stings 120 from a common support which is then automatically lowered such the plurality of luffahs 100 are partially or completely and simultaneously lowered into a pool or container of cleansing and/or moisturizing agent. The luffahs 100 may also be spray coated with the cleansing and/or moisturizing agent. At 210, the luffah 100 is removed from the cleansing and/or moisturizing agent. With the mass production method, the support is raised such that the plurality of luffahs 100 raises above the pool or container of cleansing and/or moisturizing agent. Alternatively, the spray coating ceases. At 215, the soaked luffahs 100 are dried using ambient air at room temperature or a separate heart source may be used to expedite the drying process. The drying process may also be facilitated by an air blower with or without the aid of heat. At 220, the dried luffahs 100 are packaged. The packaging may be configured to contain one or more luffahs 100.

Figure 3:
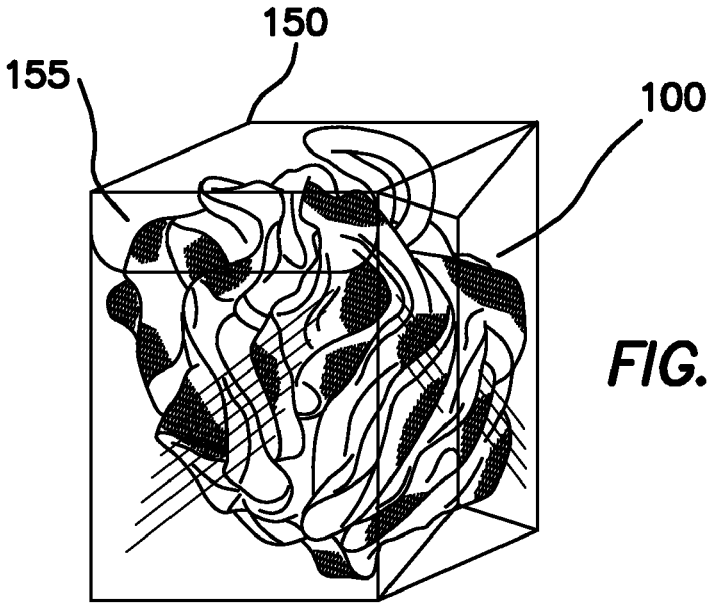
FIG. 3 illustrates an exemplary package for a single luffah.

In one embodiment, as shown in FIG. 3, a single luffah 100 container 150 comprises a transparent material containing the luffah 100. The material used for the container 150 may also be semi-transparent or opaque. The container 150 has an open end 155 temporarily sealed such that the luffah 100 may removed by unsealing the container 150. The container 150 may also depict product instructions, logo, slogans, etc. In one example, the single luffah 100 container 150 is placed in hotel (or motel) rooms for the use of guests. Depending on the hotel, the packaged luffahs 100 may be complimentary or billed to the guest in a manner similar to an honor bar. Hotels may elect to replace used luffahs 100 with new luffahs 100 on a daily basis or at least at the beginning of each new guest visit to the hotel. Hotel logos on the packaging are an ideal method for hotels to exploit their brand.

Figure 4:
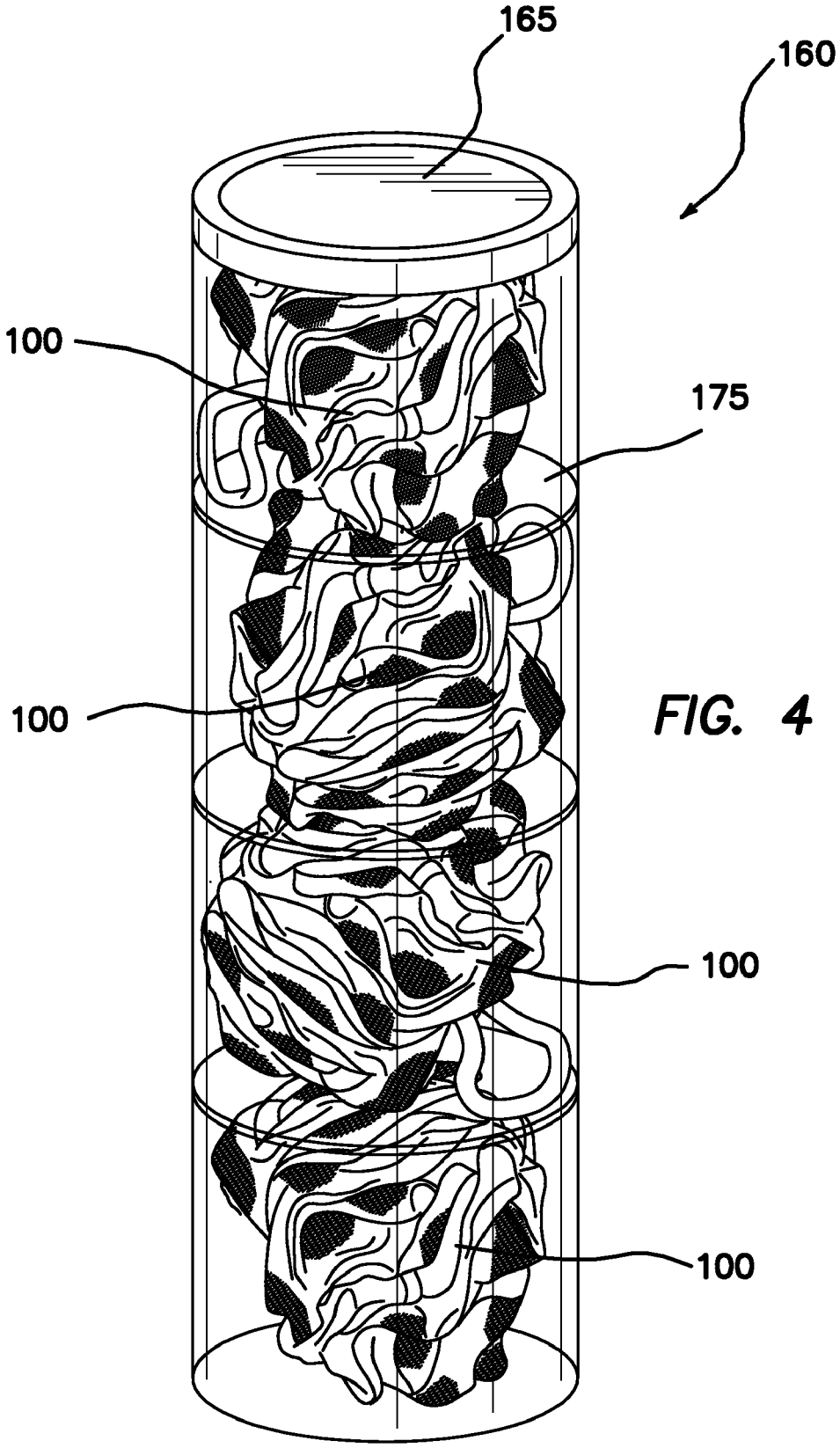
FIG. 4 illustrates an exemplary package for multiple luffahs.

In another embodiment, as shown in FIG. 4, a multiple luffah 100 container comprises a transparent (or semi-transparent or opaque) tubular container 160 fabricated of semi-rigid plastic with an open end vacuum-sealed with a pliable plastic or rubber lid 165. A series of spacers 175 may be used to keep the individual luffahs 100 from contacting one another. The vacuum created within the container 160 maintains for extended periods of time, the dry, water-soluble cleansing and/or moisturizing agent impregnated within or coated on the ruffles of the luffahs 100. Again, the tubular container 160 may depict product instructions, logos, slogans and the like. Such a container 160 is suitable for warehousing or inventorying luffahs 100 or presenting them for sale in retail outlets.

Regardless of the manner in which the luffahs 100 are sold or provided to users, it is envisioned that they shall be disposed of after limited use. That is, the luffah 100 is disposed of once the substantially dry, water-soluble cleansing and/or moisturizing agent is exhausted. Such disposability prevents the spread of bacteria, germs and the like. The cost of fabricating the luffahs 100 according to the embodiments of the present invention allows them to be easily and inexpensively replaced on a small budget. The luffahs according to the embodiments of the present invention are also ideal for travel.

Figure 5A:
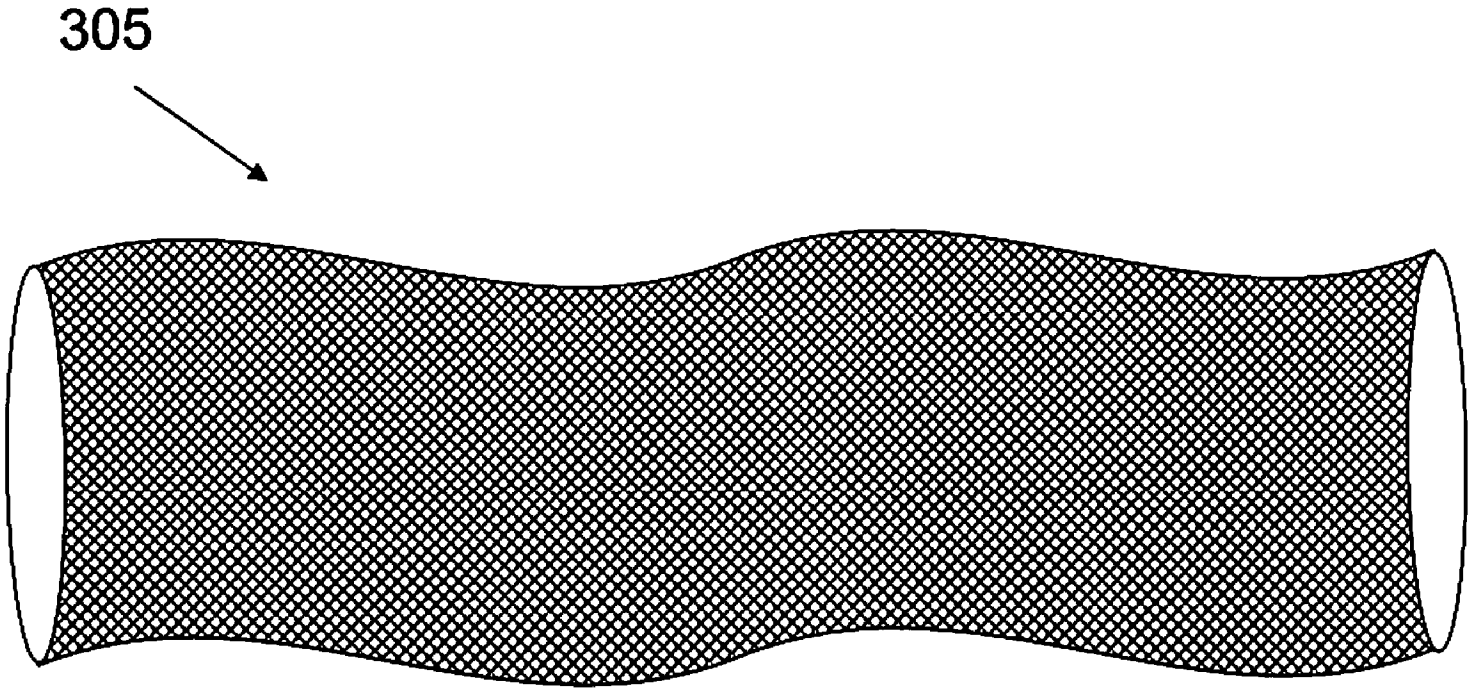
FIGS. 5*a*-5*d* illustrate a method of forming a luffah according to a second embodiment of the present invention.
Figure 5B:
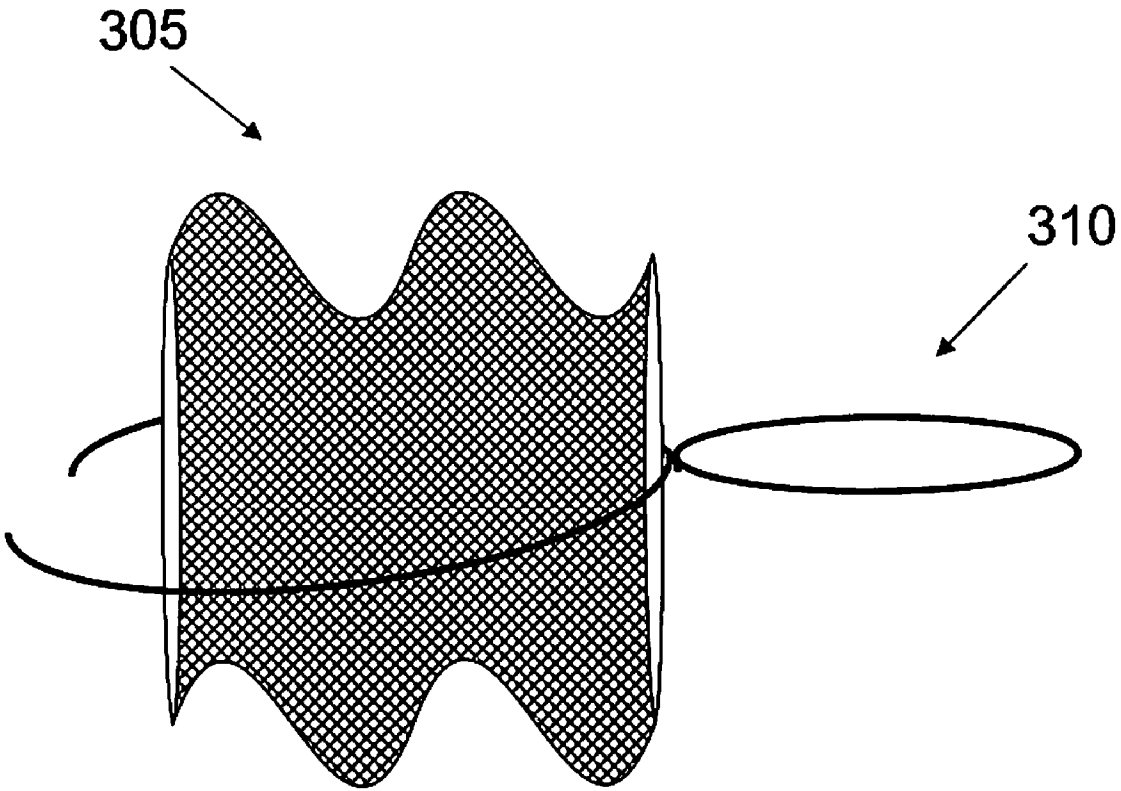
Figure 5C:
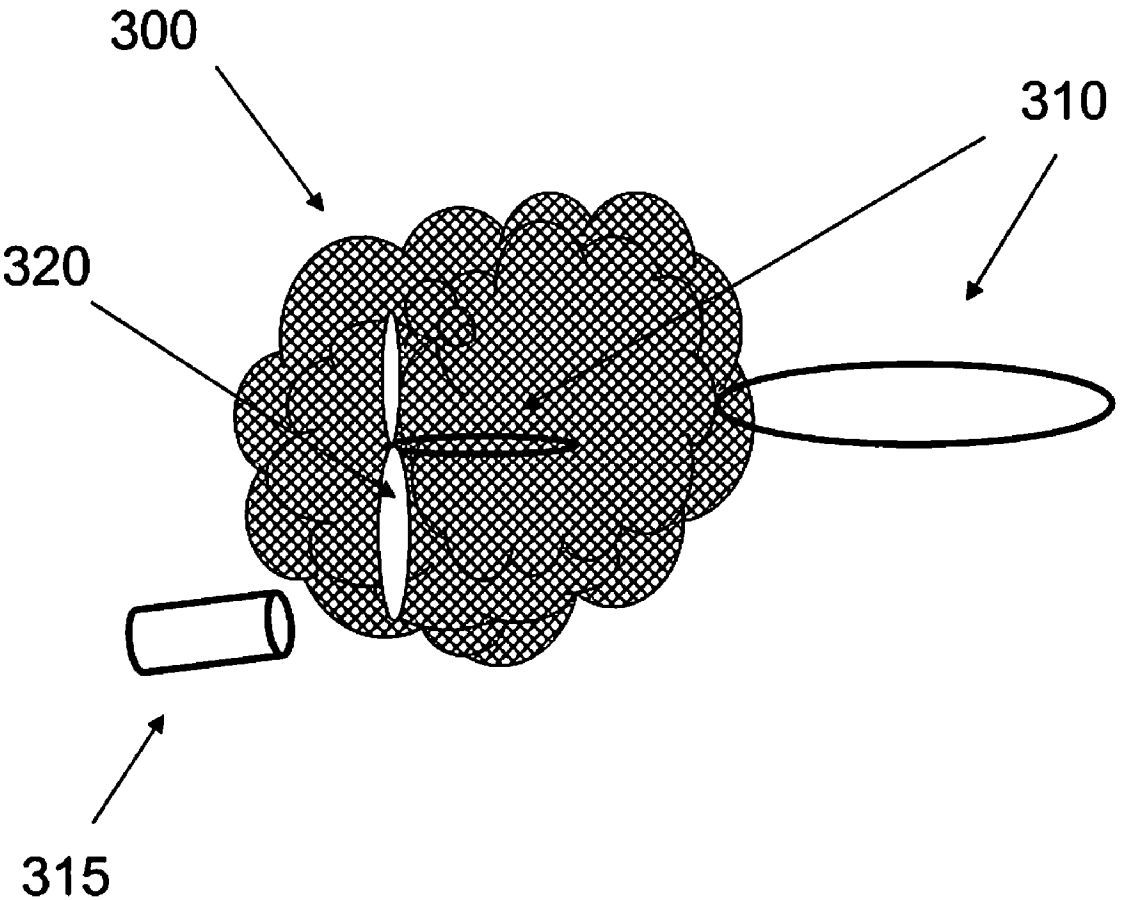
Figure 5D:
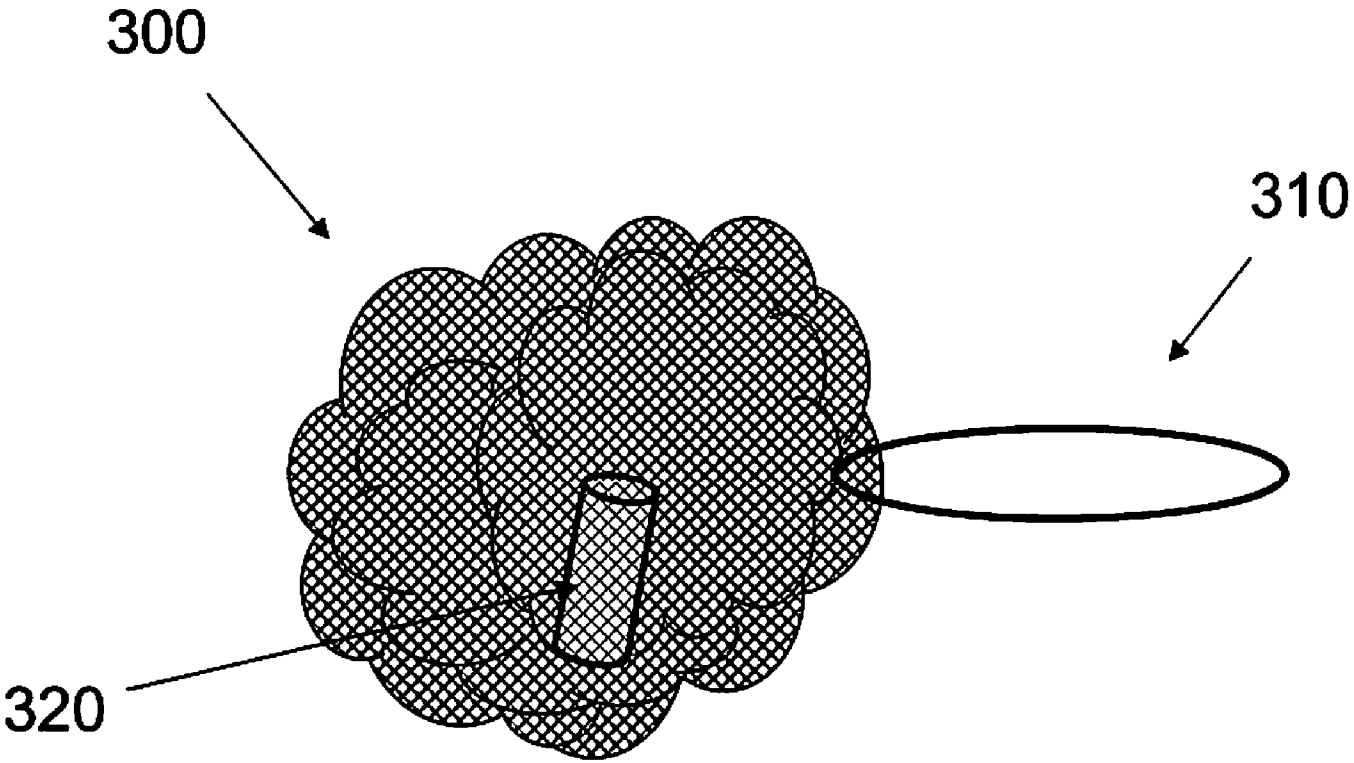

FIGS. 5*a*-5*d* show a method of fabricating a luffah 300 according to a second embodiment of the present invention. Initially, as shown in FIG. 5*a*, a net tube 305 is fabricated using conventional techniques. As shown in FIG. 5*b*, the net tube 305 is then folded along its length (i.e., scrunched) and a tie 310 is used to maintain the net tube 305 in the form of a luffah 300. A water-soluble pellet or pouch 315 is then inserted into an open end 320 of the net tube 305 as shown FIG. 5*c*. FIG. 5*d* shows the pouch 315 as it is positioned within the luffah 300.

Figure 6A:
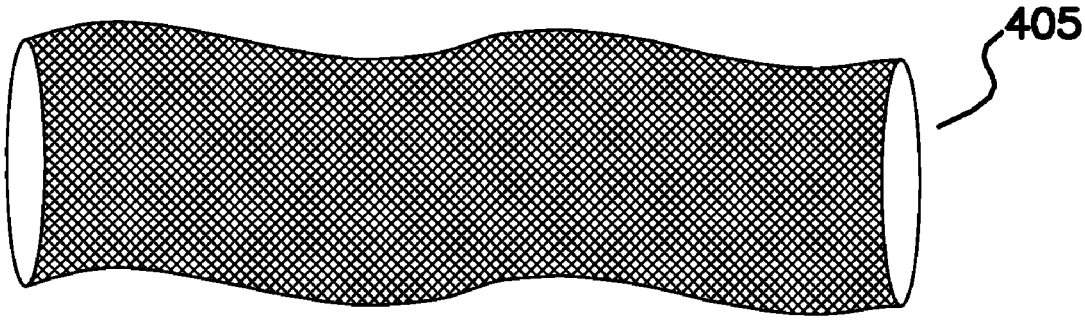
FIGS. 6*a*-6*g* illustrate a method of forming a luffah according to a third embodiment of the present invention.
Figure 6B:
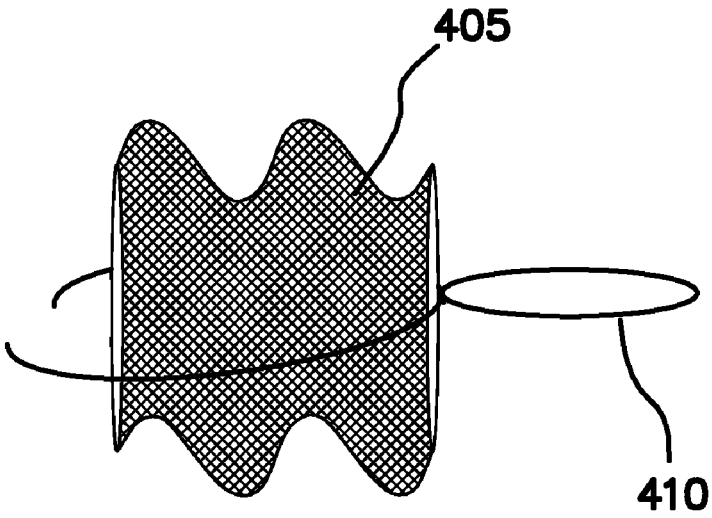
Figure 6C:
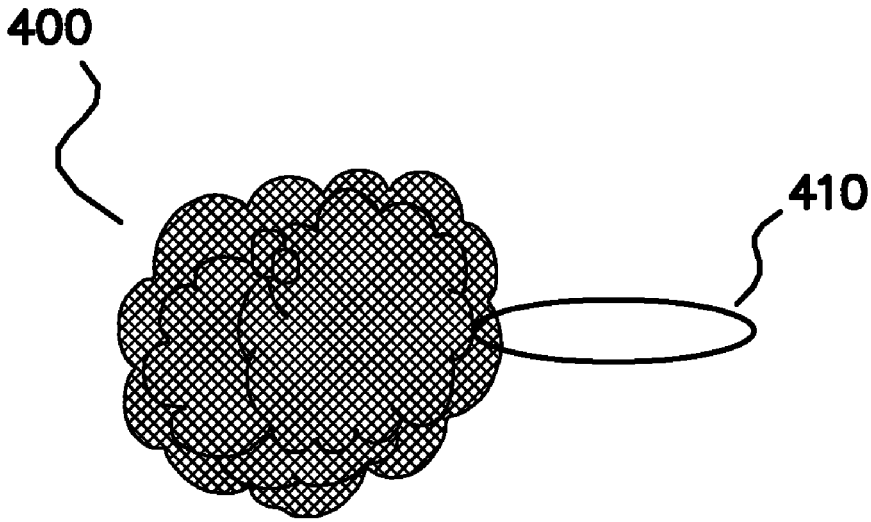
Figure 6D:
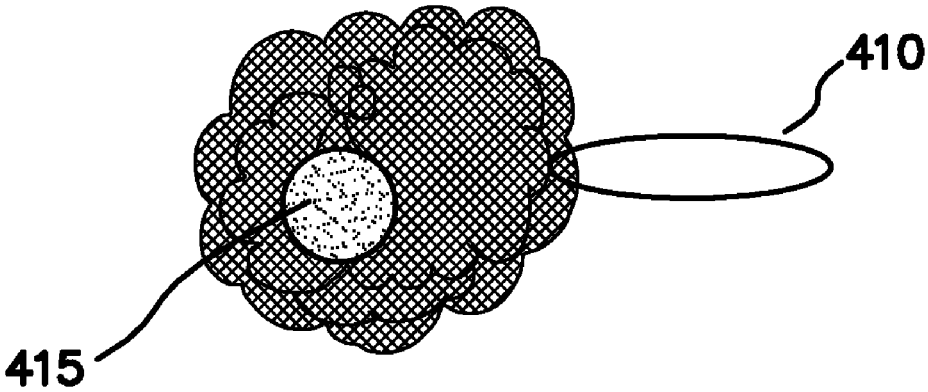
Figure 6E:
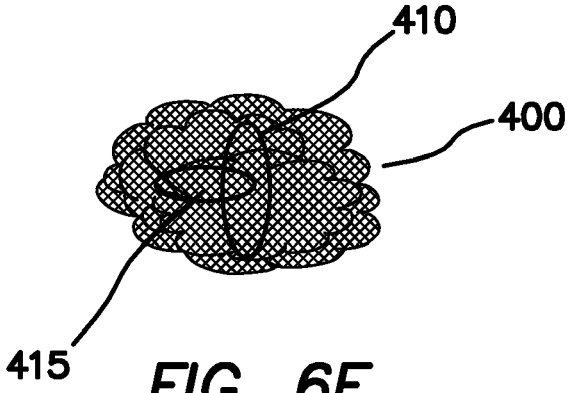
Figure 6F:
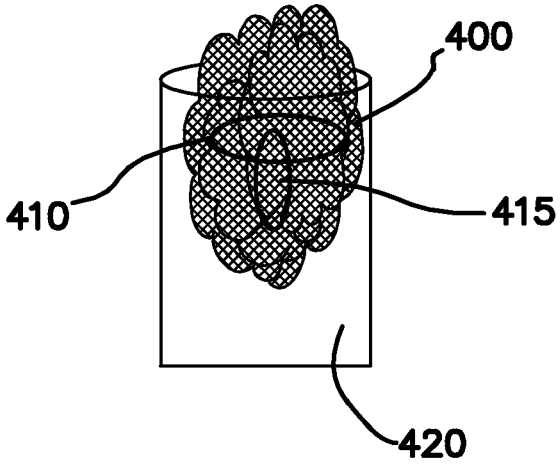
Figure 6G:
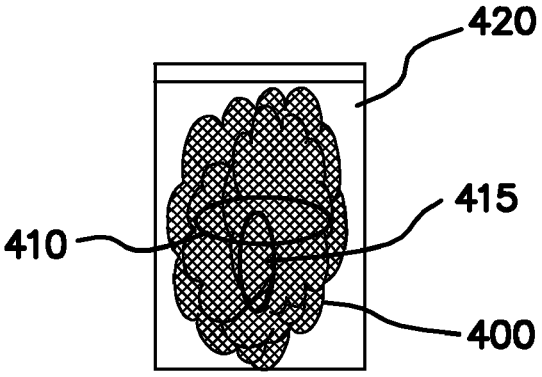

FIGS. 6*a*-6*g* show a method of fabricating a luffah 400 according to a third embodiment of the present invention. Initially, as shown in FIG. 6*a*, a net tube 405 is fabricated using conventional techniques. As shown in FIG. 6*b*, the net tube 405 is then folded along its length (i.e., scrunched) and as shown in FIG. 6*c* a tie 410 is used to maintain the net tube 405 in the general form of a luffah 400. In one embodiment, the nylon net is 7 feet long and 3.5 inches to 4 inches wide. Nets of other lengths and widths may be used as well. As shown in FIG. 6*d*, liquid soap is then injected into the middle portion or core of the luffah 400. In one embodiment, approximately 4 ml of soap 415 is injected into the luffah 400. More or less soap may be injected. The size of the luffah 400 may also require more or less soap. As shown in FIG. 6*e*, the luffah 400 is then further compressed or wrapped around the injected soap. As shown in FIGS. 6*f* and 6*g*, the luffah 400 is then packaged in a bag 420 which is heat sealed or tape sealed. In one embodiment, the bag is fabricated of clear polypropylene although other materials may be used. The packaging may occur before or after the soap is fully dry.

Although the invention has been described in detail with reference to several embodiments, additional variations and modifications exist within the scope and spirit of the invention as described and defined in the following claims.

We claim:

1. A method of fabricating a cleansing device comprising:

injecting a substantially wet, cleansing and/or moisturizing agent at, or near, a core of a luffah such that said substantially wet, cleansing and/or moisturizing agent coats ruffles at said core of said luffah;

compressing said luffah around said injected cleansing and/or moisturizing agent; and drying said applied substantially wet, cleansing and/or moisturizing agent such that a generally dry, water-soluble, cleansing and/or moisturizing agent is concentrated on ruffles at said core of said luffah.

2. The method of claim 1 further comprising packaging said luffah in a polypropylene bag.

3. The method of claim 2 further comprising sealing said polypropylene bag using heat or tape.

4. The method of claim 1 further comprising utilizing a heat source to dry said applied substantially wet, cleansing and/or moisturizing agent.

5. The method of claim 1 further comprising utilizing a blower to dry said applied substantially wet, cleansing and/or moisturizing agent.

6. The method of claim 1 further comprising injecting about 4 milliliters of substantially wet, cleansing and/or moisturizing agent at a core of said luffah.

7. A method of fabricating a cleansing device comprising:

forming a nylon tube into a luffah;

injecting a substantially wet, cleansing and/or moisturizing agent at, or near, a core of said luffah such that said substantially wet, cleansing and/or moisturizing agent coats ruffles at said core of said luffah;

compressing said luffah around said injected cleansing and/or moisturizing agent; and drying said applied substantially wet, cleansing and/or moisturizing agent such that a generally dry, water-soluble, cleansing and/or moisturizing agent is concentrated on ruffles at said core of said luffah.

8. The method of claim 7 further comprising packaging said luffah in a polypropylene bag.

9. The method of claim 8 further comprising sealing said polypropylene bag using heat or tape.

10. The method of claim 7 further comprising utilizing a heat source to dry said applied substantially wet, cleansing and/or moisturizing agent.

11. The method of claim 7 further comprising utilizing a blower to dry said applied substantially wet, cleansing and/or moisturizing agent.

12. The method of claim 7 further comprising applying a substantially wet, cleansing and/or moisturizing agent in the form of clear liquid soap, gel, bath wash or body wash.

13. The method of claim 7 further comprising forming an about 7 foot long and 4 inch wide nylon net into said luffah.

* * * * *